United States Patent [19]

Mancuso

[11] Patent Number: 4,555,868

[45] Date of Patent: Dec. 3, 1985

[54] VINYL TILT WINDOW ASSEMBLY

[75] Inventor: Paul Mancuso, Mamaroneck, N.Y.

[73] Assignee: Fiberlux, Inc., Richmond, Va.

[21] Appl. No.: 538,577

[22] Filed: Oct. 3, 1983

[51] Int. Cl.[4] ..... E05D 15/22

[52] U.S. Cl. ..... 49/181; 49/501; 49/504

[58] Field of Search ..... 49/181, 501, 504

[56] References Cited

U.S. PATENT DOCUMENTS

| | | | |
|---|---|---|---|
| 3,703,063 | 11/1972 | Budich et al. | 52/727 |
| 3,859,754 | 1/1975 | Budich et al. | 40/425 |
| 4,259,813 | 4/1981 | Winner et al. | 49/504 |
| 4,286,716 | 9/1981 | Budich et al. | 206/577 |
| 4,351,131 | 9/1982 | Kubik | 49/501 |
| 4,398,373 | 8/1983 | Mancuso | 49/504 X |

FOREIGN PATENT DOCUMENTS

| | | | |
|---|---|---|---|
| 2253387 | 6/1975 | France | 49/181 |

OTHER PUBLICATIONS

Fiberlux Specification Sheet.

*Primary Examiner*—Kenneth Downey
*Attorney, Agent, or Firm*—Brumbaugh, Graves, Donohue & Raymond

[57] ABSTRACT

A tilt window includes a frame with a sill, a header and a pair of jambs, each extruded from rigid plastic material. Each member is formed of multi-hollow construction for overall strength and rigidity. The jamb comprises, in cross-section, a base and an inner leg, an outer leg and center leg projecting from the base to form inner and outer channels. A portion of each center leg and outer leg projects to form a sash engagement panel. The sashes are held within the respective channels by sliding balance shoes and latch members, and may be tilted inwardly away from the sash engagement panels for cleaning.

8 Claims, 7 Drawing Figures

FIG. 1
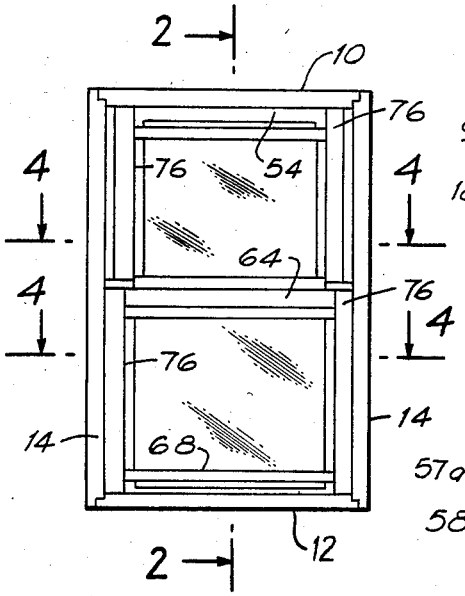
FIG. 2
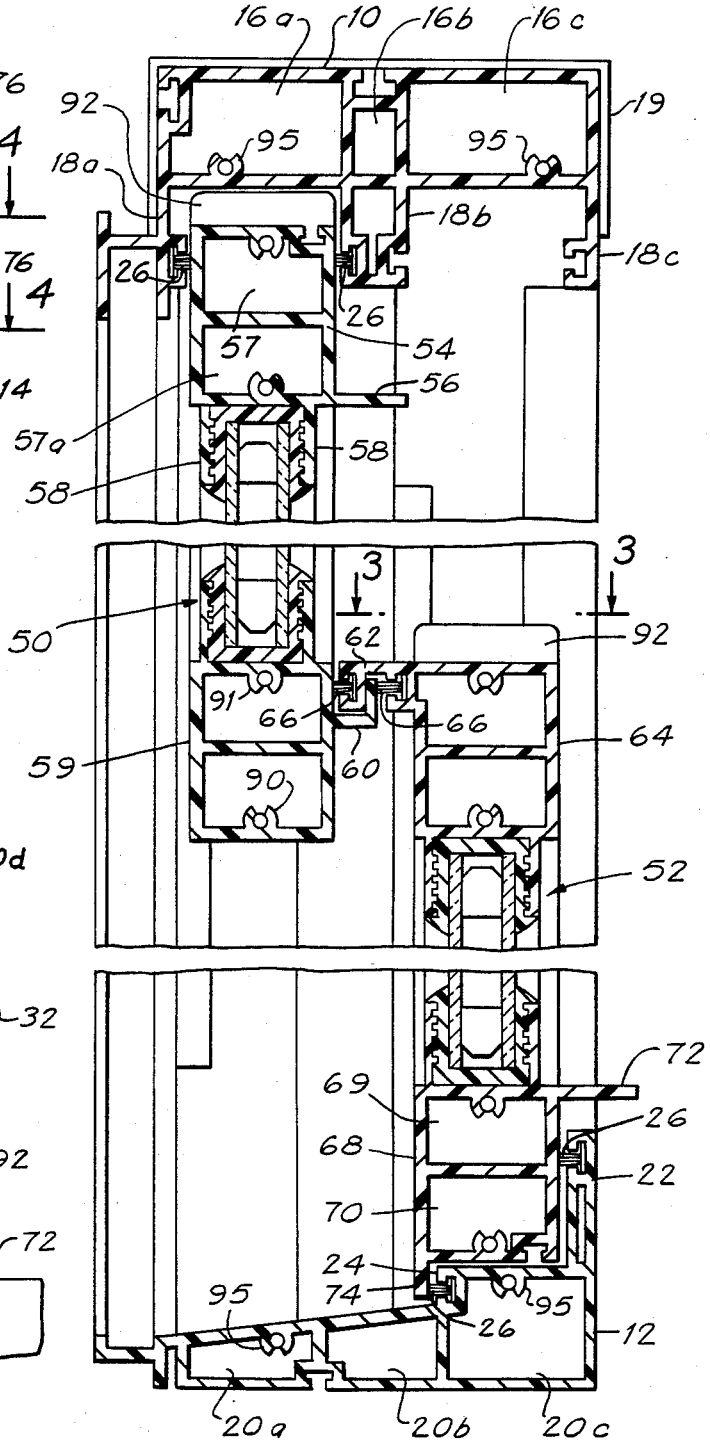
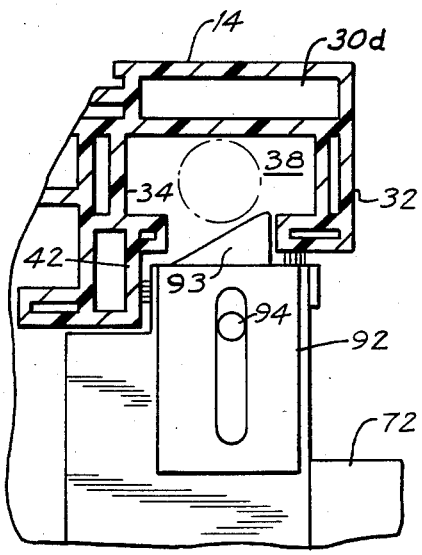
FIG. 3

VINYL TILT WINDOW ASSEMBLY

BACKGROUND OF THE INVENTION

The present invention is a rigid vinyl tilt window, which preferably has insulating glass but may accommodate single glass.

In a tilt window construction, each sash is supported by a pair of shoes, each of which rides in a channel in the frame for raising and lowering the window. Since unlike conventional windows, the sash does not sit in its own channel, the sash may be tilted inwardly. Tilt windows have increased in popularity in recent years due to the ease of cleaning offered by such a construction. However, because of the fact that the sashes are not disposed in channels, a tilt window is normally not as energy efficient as conventional windows.

Window frames and sashes are normally constructed of wood, steel, or aluminum, both in the conventional series and in tilt series windows. The use of rigid vinyl as a construction material is preferable from the standpoint of materials costs, lower heat and cold conductivity, self-lubrication, and due to the fact that rigid vinyl does not need to be painted and does not rust, rot, corrode or pit. But, due to basic differences in materials properties, the cross-sectional profiles used in wood, aluminum, or steel windows are generally unsuitable for rigid vinyl.

The assignee of the present application, Fiberlux Products, Inc., markets a rigid vinyl channel series window which has inherent strength and which exhibits excellent thermal insulation with a minimum of air leakage. It is constructed from a series of extrusions, which are cut and sized for the particular window application. Each of the frame members, i.e. a header, a sill, and a pair of jambs, and each sash member, is formed by a series of interacting hollows to impart overall rigidity in strength to the frame and sash members.

It would be desirable to construct a tilt series window having equal ability to withstand environmental loads and stresses. It would also be desirable to provide a rigid vinyl tilt series window having improved draft resistance over conventional designs. Finally, in view of the fact that extrusion dies for rigid vinyl are expensive, it would be desirable to provide a tilt series window in which extrusion members are interchangeable with those employed in channel series windows.

SUMMARY OF THE INVENTION

The present invention is a tilt window formed of rigid plastic material, preferably rigid vinyl (PVC). The frame includes a header, a sill, and a pair of jambs. The header and sill are each formed, in cross-section, to have a base portion, formed by at least one hollow, and sections depending therefrom forming a pair of adjacent channels. The channels are formed so as to be capable of receiving the upper or lower end of a sash in sealing relationship.

Each jamb is formed, in cross-section, to have a base portion formed by at least one hollow, with an outer leg, and inner leg, and a center leg therebetween projecting from the jamb base portion to form side-by-side inner and outer channels. The center leg projects a distance further than the inner leg, to define a first sash engagement panel. The outer leg projects a distance further than the center leg, to define a second sash engagement panel. The outer, center and inner legs are each integral with the jamb base portion and formed by at least one hollow such that each channel is capable of providing lateral support to sash support members, and each panel forms a rigid surface, engageable with a sash member, to provide weather sealing.

Each sash includes a pair of horizontal sash rails and a pair of vertical sash stiles, which support insulated (or single pane, if desired) glass. Each sash stile and rail is preferably formed of at least one hollow. A pivot bar extends laterally from each side of a lower portion of the sash, into the respective inner or outer channel, where it is received in a sash support shoe. The shoe is designed to slide up and down the channel, for raising and lowering the window. Preferably, the shoe is provided with a conventional cam brake, such that when the sash is tilted, the pivot bar causes the brake to engage the channel walls, to prevent the shoe from moving as the window is tilted. A pair of tilt latches are mounted on the upper end of each sash and project into the respective channel to hold the window in the channel. The latches slide in the channel for raising and lowering the sash, and can be withdrawn from the channel for tilting the window.

The lower horizontal sash rail of the upper sash, and the upper horizontal sash rail of the lower sash, are each provided with a lock rail for producing integral interlock, and weather sealing, between the sashes when the window is closed. The top and bottom sash rails of the upper and lower sashes, respectively, are formed with top and bottom lifts for lowering and raising the sashes. Each of these lifts is preferably extruded so as to be integral with the respective rail.

In a preferred construction of the jamb, each sash engagement panel is formed by a hollow integral with, and extending from, the portion of the leg defining the respective channel. Preferably also, a pair of opposed bracket portions extend from the edge of each respective channel, so as to partially close off the channel, each bracket portion being formed by a hollow integral with its respective leg.

Preferably, the header and sill of the frame, and the sash members, are interchangeable with those presently employed in the channel series window marketed by Fiberlux Products, Inc. so that such members may be used to construct either a channel series window or a tilt series window. Accordingly, by merely interchanging the tilt window and channel window jamb members, and in the case of a tilt window providing the appropriate tilt shoes and latches, essentially the same extrusions can be used to construct either a channel series window or a tilt series window. In either case, the resultant window has inherent strength, excellent thermal properties, providing effective sealing against air infiltration, and is economical to produce and construct.

For a better understanding of the invention, reference is made to the following detailed description of the preferred embodiments, taken in conjunction with the drawings of the application.

BRIEF DESCRIPTION OF THE DRAWINGS

FIG. 1 is a front view of a tilt window in accordance with the invention;

FIG. 2 is a cross-sectional view of the window of FIG. 1, taken through lines 2—2;

FIG. 3 is a partial sectional view, taken through lines 3—3 of FIG. 2;

DETAILED DESCRIPTION OF THE PREFERRED EMBODIMENTS

Figure 4:
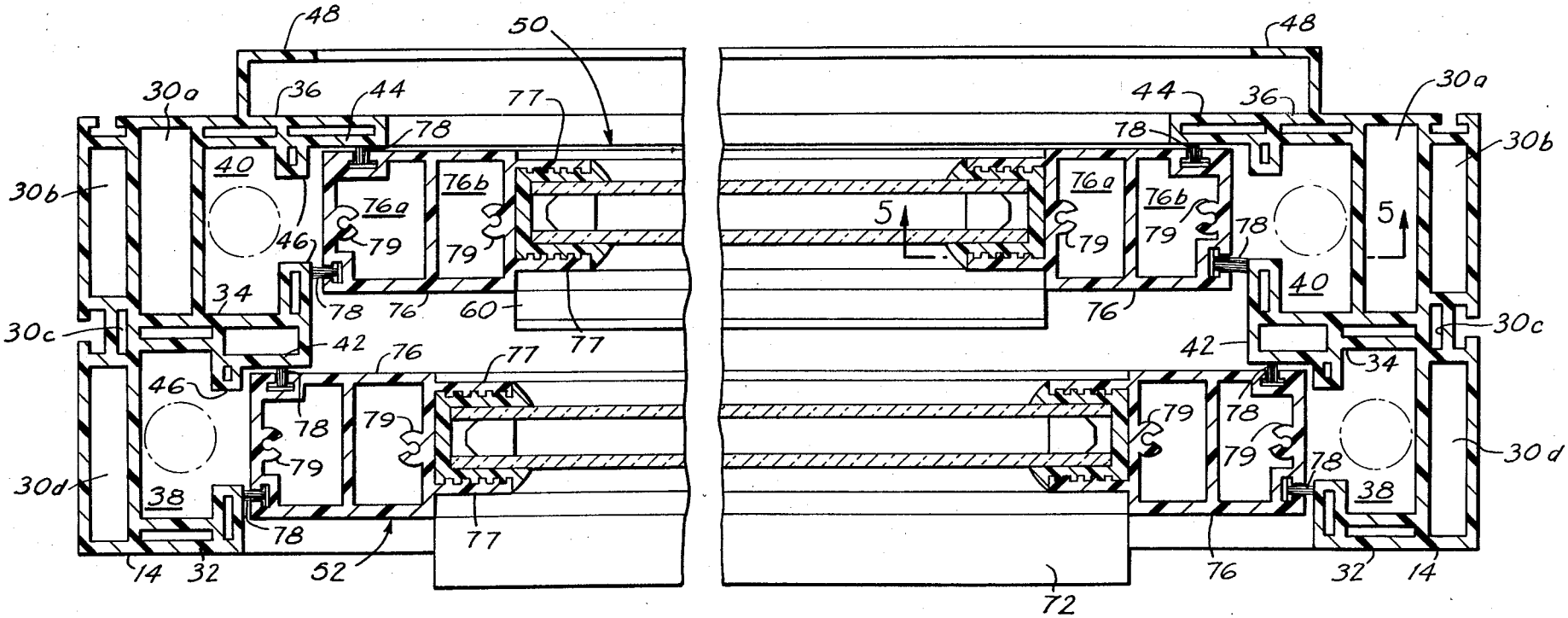
FIG. 4 is a horizontal sectional view of the window of FIG. 1, taken through lines 4—4.

A rigid vinyl tilt window in accordance with the invention includes a frame having a header 10, a sill 12, and a pair of jambs 14. The header 10 has, in cross-section, a base portion formed by adjacent, integral hollow sections 16*a*, 16*b*, and 16*c*, and sections 18*a*, 18*b* and 18*c* depending therefrom forming a pair of adjacent channels. As shown in FIG. 2, a cover 19 (which is omitted in FIG. 1) may be mounted over the header 10.

As used herein, the term "hollow" refers to a cross-sectional profile in which adjoining walls enclose a hollow space and in which, due to the orientation of the walls at an angle to one another, preferably at generally right angles, the profile resists bending stress at different angles. The term "integral" means that two adjoining hollows share at least one common wall.

The sill 12 also has a base portion, formed by adjacent hollow sections 20*a*, 20*b* and 20*c*. Preferably, as shown, the sill is sloped to facilitate water drainage. The sill is provided with a vertical panel 22 for engaging an interior facing surface of the lower sash. The sill is also provided with an outwardly facing surface 24 for engagement of the outside wall 74 of the lower sash, so that panel 22 and surface 24 provide two sealing barriers. The panel 22 is integral with section 20*c* and is formed by a hollow for enhancing strength and rigidity. As shown in FIG. 2, the frame members 10 and 12 are provided with weather stripping 26 at those portions engaging the sash members for inhibiting air infiltration. The weather stripping 26 is mounted in elongated slots formed in the extruded frame members 10, 12.

Referring to FIG. 4, the frame jamb members 14, both of which may be cut from the same extrusion, each has a base portion formed by a plurality of hollows 30*a*, 30*b*, 30*c* and 30*d*, section 30*c* forming a hollow parting strip. The hollows are integral with one another to provide overall strength and rigidity. Projecting from the jamb base portion are an inner leg 32, a center leg 34, and an outer leg 36, so as to form an inner channel 38 and outer channel 40.

The center leg 34 has a first portion generally co-extensive with the inner leg 32, to form the inner channel 38. A second portion projects a distance further than the inner leg 32 to define a first sash engagement panel 42. Similarly, the outer leg 36 has a first portion generally co-extensive with at least the panel 42, to form the outer channel 40, and a second portion which projects a distance further than the center leg 34 to define a second sash engagement panel 44. The hollow 30*a* acts as a spacer for the outer channel 40 of each jamb such that the channels 40 are spaced toward the interior of the frame relative to the inner channels 38. The outer, center and inner legs are each integral with the jamb base portion 30*a–d* and formed by at least one hollow such that each channel is capable of providing lateral support to sash support members, and each panel forms a rigid surface, engageable with a sash member, to provide weather sealing as described below.

Preferably, a pair of opposed bracket portions 46 partially close off the outer end of each channel 38, 40. Each bracket portion 46 is formed as a hollow integral with its respective leg. As shown, guide brackets 48 may also be provided to support a window screen.

The double hung window includes an outer sash 50 and an inner sash 52, which in the construction shown form the upper and lower window sashes, respectively. Each sash 50, 52 is formed by a pair of horizontal rails and a pair of vertical stiles.

Referring to FIG. 2, the upper sash 50 includes a top sash rail 54, formed by a integral pair of hollows, 57, 57*a*, and a pair of spaced walls 58 defining a glazing channel, which is typical of each of the sash rails. It also has an integral lift rail 56 for raising and lowering the window. The bottom sash rail 59 is formed by an integral pair of hollows and glazing channel walls, and includes a generally L-shaped locking rail 60.

The locking rail 60 interlocks with a locking rail 62 of the top sash stile 64 of the lower sash 52. As shown, the center leg of the jamb spaces the two sashes, and the locking rails 60, 62 project into this space to provide mechanical interlock. This assures that when the window is closed the upper and lower sashes 50, 52 remain locked together. The rail 62 is generally L-shaped so as to interlock with member 60, and the rail 62 and adjoining surface of stile rail 64 are extruded to have dual grooves for receiving weather stripping 66. Both due to the tortuous path between the interlocking members and the dual weather stripping, air infiltration is effectively inhibited.

The lower horizontal sash rail 68 is also formed by an integral pair of hollows 69, 70. The member 68 may also be provided with a lift rail 72, and has a downwardly projecting panel 74 to engage the abutting section 24 of the sill 12.

Referring to FIG. 4, each vertical sash stile 76 is formed by a pair of integral hollows 76*a*, 76*b* with walls 77 depending therefrom and forming a glazing channel for receiving a glass panel. A pair of opposed screw bosses 79 are formed on the interior of hollows 76*a*, 76*b*.

Each of the vertical sash stiles 76 is identical and may be cut from a single extrusion. Weather stripping 78, preferably of woven pile, is provided between the vertical stile 76 and the sash engagement panels 42, 44, and between the vertical stiles 76 and the inner projecting portions 46. The weather strips 78 are mounted in T-shaped grooves formed in the extrusion members as shown. Double glazed insulating glass is used in each of the sash members 50, 52, and sealed with a marine wrap around glazing. Alternatively, single glass may be used.

Figure 5:
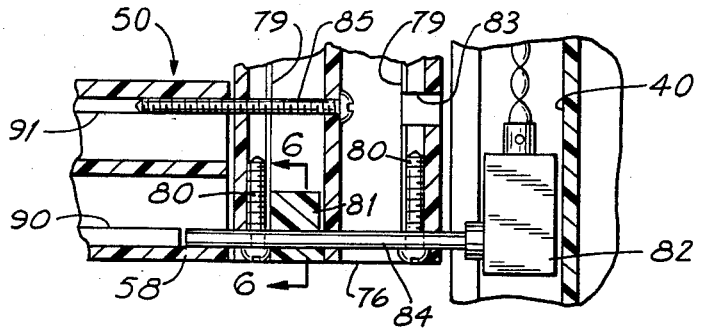
FIG. 5 is a sectional view, taken through lines 5—5 of FIG. 4, illustrating the attachment of the pivot bar and slider shoe to the sash.

As can be seen from FIGS. 1 and 5, in a preferred construction of the sash the vertical stiles 76 are cut to extend from top to bottom (excepting portions of the glazing channel). The lower horizontal rails extend between the stiles. The upper rails also extend between the stiles but if desired, the uppermost well of the upper rail may extend further to either side, to cover over the open, upper ends of the stiles, the remainder of the rail being cut away (see FIG. 3).

Figure 6:
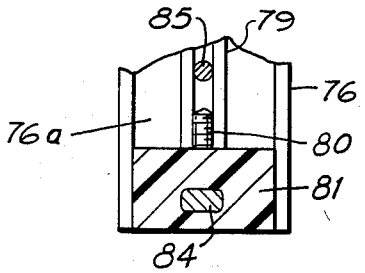
FIG. 6 is a sectional view, taken through lines 6—6 of FIG. 8.

FIGS. 5 and 6 illustrate the mounting of the sash to the frame. A balance shoe 82 (which is omitted in FIG. 4 for clarity) is provided on either side of the lower end of each sash. Each shoe 82 is positioned in its respective channel, the shoe for channel 40 being shown, and can slide up and down. The balance shoe 82 may be any conventional type used in tilt windows, for example of the type manufactured by the Caldwell Company, and is attached to the helical rod portion of a conventional balance. A pivot bar 84, which is essentially rectangular or elliptical in cross-section, projects from each balance shoe 82, and is secured within the lower part of the sash 50. A groove or slot is cut in the bottom edges of the walls forming hollows 76*a*, 76*b* so that the pilot bar 84 extends through the stile 76 perpendicular to the screw bosses 79. The pivot bar extends partially into the horizontal sash rail 59 (a portion of the screw boss 90 being cut away). A pair of screws 80 extend through holes in the pivot bar and are screwed into the respective screw bosses 79 so as to secure the pivot bar 84 relative to the vertical stile 76. Also, a pivot bar retainer block 81 is fitted in the hollow 76*a*. As shown in FIG. 6, the block 81 has an elliptical hole to receive the pivot bar 84, and is shaped to fit between the walls forming hollow 76*a*. Accordingly, when the sash is tilted, the pivot bar pivots along with it.

FIGS. 5 and 6 illustrate the manner of attaching the horizontal and vertical sash members. A hole 83 is made through the outer wall of stile 76 to provide access to the inner wall, where a screw 85 is inserted through the outer wall of stile 76, through plug 81 and through holes formed in the remaining walls in the stile 76 and is screwed into the upper horizontal screw boss 91. Preferably, the horizontal and vertical members are also bonded together using a suitable cement.

The upper horizontal rails, 64, 54, of each of the sashes supports a tilt latch housing 92, which includes a retractable latch 93 (FIG. 3). By sliding the latch elements 93 toward one another, using pins 94, the upper portion of the sash may be tilted inwardly, away from sash support panel 42, 44. Referring to FIG. 2, the upper portion of each sash 50, 52 tilts to the right (the upper sash 50 must first be lowered slightly to avoid interference with leg 18*b*; similarly lower sash 52 must be raised slightly from the FIG. 2 position when tilted to avoid interference with panel 22). As the sash pivots, pivot bar 84 likewise pivots, which causes a cam mechanism (not shown) in shoe 82, which is conventional in such balance shoes, to grip the walls of the channel 40 and lock the balance shoes 82 in place.

Figure 7:
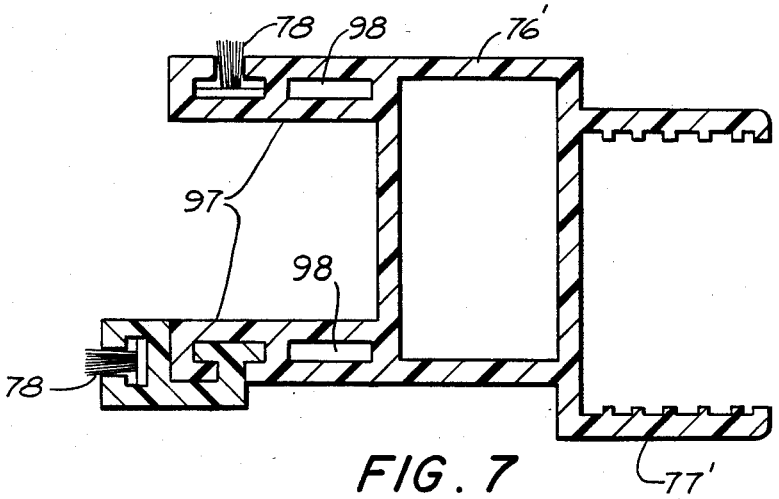
FIG. 7 is an alternative embodiment of a vertical sash stile for use in the invention.

FIG. 7 shows an alternative embodiment of a vertical sash stile 76'. Weather strips 78 are supported on two legs 97, formed with hollows 98 for rigidity. A bracket 78' supports one of the two weather strips 78 so that the weather strips 78 are oriented similar to those in FIG. 2. since there are no screw bosses, the pivot bars 84 attach to the sash 50 inside the lower sash rails 59, 68. Preferably, the horizontal sash rails 59, 68 extend across the entire width of the sash, with the vertical stiles 76*a* spaced therebetween, i.e. the reverse of FIG. 1. In connecting the pivot bars 84, the bar 84 extends into the lower hollow of horizontal rail 59, 68 and a pair of pivot blocks, similar to pivot bar retainer block 81, are disposed inside rail 59, 68. Mounting screws extend through the bar 84 into the pivot blocks to fix the bar 84 relative to the sash rail 59, 68.

The main frame members are attached in a manner similar to that used to assemble the sash. Preferably, access holes are made through the jambs to the jamb wall directly abutting screw bosses 95 in the horizontal frame members. There screws extend through the remaining jamb wall into the screw bosses 95.

Preferably, all of the sash extrusion members, the header, and the sill employed in the tilt window in accordance with the invention are interchangeable with corresponding members of the Fiberlux channel series window. The jamb members of the present invention may be substituted for the jamb members of the channel windows, and preferably the tilt window is assembled using weather-tight, butt-corner construction as used in the Fiberlux channel series. In the preferred construction, all the frame and sash members are made from high impact extruded rigid vinyl (PVC) approximately 0.07 inches thick, with solid color throughout the members. As described above, the jamb is a dual wall, 13 hollow construction with a hollow parting strip and a sash support area of multi-hollow construction. The interlock, when closed with the upper and lower sash members, forms a T-bar with double weather-pile grooves. Tilt Double hung windows are provided with four spiral type balances, two in each sash, which engage the balance shoes in conventional manner. For larger windows, four balances per sash may be installed. Preferably, all joints, both main frame and sash, are butt-joined with screws anchored into integral screw bosses 95 as shown in the drawings. The main frame joints and sash frame joints are sealed with a parent cement.

The foregoing represents the description of a preferred embodiment of the invention. Variations and modifications of the construction shown and described will be apparent to persons skilled in the art, without departing from the inventive concept shown herein. For example, instead of using two pivot bars for each sash, each extending only partially into the horizontal lower rail, a single pivot bar may be used between the opposed balance shoes. All such modifications and variations are intended to be within the scope of the invention, as defined in the following claims.

I claim:

1. A tilt window frame comprising a header, a sill, and a pair of jambs, each made of rigid plastic;

wherein said header and said sill each comprise, in cross-section, a base portion, formed by at least one hollow, and sections integral therewith and depending therefrom for engaging a sash member; and wherein each jamb is a rigid plastic, one-piece extrusion comprising, in cross-section, a base portion and an outer leg, an inner leg, and a center leg therebetween, said legs projecting from said base portion toward the interior of said frame, wherein:

said base portion is formed by a plurality of integral hollows including a hollow parting strip and a spacer hollow;

said inner leg is formed by at least one hollow integral with a hollow of said base portion;

said center leg projects from said hollow parting strip and has a first portion formed by at least one hollow integral with said hollow parting strip and integral with said spacer hollow, the aforesaid first portion also being generally co-extensive with said inner leg to define, with said inner leg, an inner channel, and said center leg including a second portion formed by at least one hollow integral with a hollow of said first portion and projecting a distance further than said inner leg to define a first sash engagement panel; and said outer leg has a first portion formed by at least one hollow projecting from and integral with said spacer hollow, the first portion of said outer leg being generally co-extensive with the second portion of said center leg to define, with said center leg, an outer channel spaced toward the interior of said frame relative to said inner channel; and said outer leg including a second portion formed by at least one hollow integral with a hollow of the first portion of said outer leg and projecting therefrom a distance further than said center leg to define a second sash engagement panel, said inner and outer channels being arranged to guide slideable sash support members whereby each panel forms a rigid surface, engageable with a sash member, to provide effective weather sealing.

2. A tilt window frame as defined in claim 1, wherein said jamb has opposed bracket portions on said legs, arranged on the open sides of said channels for partially closing off said channels, wherein each bracket portion is formed by at least one hollow integral with its respective leg.

3. A tilt window having a tilt window frame as defined in claim 1 and comprising an outer sash, an inner sash, wherein each sash includes a pair of vertical sash stiles and a pair of horizontal sash rails, each a rigid plastic, one piece extrusion formed by at least one hollow, and means disposed in said inner and outer channels for supporting a respective sash and for permitting the sash to tilt away from the respective sash engagement panel.

4. A tilt window as defined in claim 3, wherein the support means comprise a balance shoe disposed in each channel, a pivot bar extending from each balance shoe into a lower portion of said sash, and retainer means for securing said pivot bar to said lower portion.

5. A tilt window as defined in claim 4, wherein each said vertical stile has at least one screw boss forming part of said retainer means, and wherein said retainer means comprises screw means engaging said pivot bar and said screw boss for securing said pivot bar to said vertical stile.

6. A tilt window as defined in claim 5, wherein said retainer means further comprises a pivot bar retainer block disposed within a hollow of each vertical sash stile and engaging said pivot bar.

7. A tilt window as defined in claim 4, wherein said retainer means comprises a pivot bar retainer block disposed within a hollow of said sash and engaging said pivot bar.

8. A tilt window as defined in claim 3, comprising interlock means formed on said sashes for engaging when the window is closed for inhibiting air and water infiltration between sashes.

* * * * *

UNITED STATES PATENT AND TRADEMARK OFFICE

CERTIFICATE OF CORRECTION

PATENT NO. : 4,555,868

DATED : December 3, 1985

INVENTOR(S) : VINYL TILT WINDOW ASSEMBLY

It is certified that error appears in the above-identified patent and that said Letters Patent is hereby corrected as shown below:

Title Page, Left Column, Second Line, "MANCUSO" should be -- MANCUSO et al --;

Title Page, Left Column, Fourth Line, after "[75] Inventor: Paul Mancuso, Mamaroneck, N.Y." add -- and Anthony Mongelli, Yonkers, N.Y. --;

Column 4, line 57 "well" should be -- wall --; and

Column 5, line 6, "pilot" should be -- pivot --.

Signed and Sealed this

*Fifth* Day of *August 1986*

[SEAL]

*Attest:*

DONALD J. QUIGG

*Attesting Officer*

*Commissioner of Patents and Trademarks*